United States Patent [19]

Joun

[11] 4,428,084

[45] Jan. 31, 1984

[54] WATER CONTROL DEVICE FOR FLUSH TOILET

[76] Inventor: Chong-Long Joun, 1st F., No. 28, Kuang-Fu Rd., Chungho 235, Taiwan

[21] Appl. No.: 332,512

[22] Filed: Dec. 21, 1981

[51] Int. Cl.[3] ..... E03D 5/02

[52] U.S. Cl. ..... 4/407

[58] Field of Search ..... 4/324, 415, 388, 407, 4/413

[56] References Cited

U.S. PATENT DOCUMENTS

| | | | |
|---|---|---|---|
| 3,038,168 | 6/1962 | McFarlane | 4/413 |
| 4,014,050 | 3/1977 | Goldsworthy | 4/388 |
| 4,138,749 | 2/1979 | Clark | 4/415 |
| 4,333,184 | 6/1982 | Wang | 4/388 |

*Primary Examiner*—Charles E. Phillips

*Attorney, Agent, or Firm*—Cushman, Darby & Cushman

[57] ABSTRACT

This invention relates to a "Water Control Device for Flush Toilet". The water may be flushed in several phases thru the control means, which comprises a hydraulic control assembly, the actuation between the main axle and the actuating axle, a lever, and a actuating rod to control a water stop lid for water saving purpose.

7 Claims, 4 Drawing Figures

WATER CONTROL DEVICE FOR FLUSH TOILET

BACKGROUND OF THE INVENTION

As a result of the prosperity and progress of the present industrial and commercial activities, the flush toilet has become indispensable in homes and apartments. The use of a large number of toilets, many of which are flushed many times everyday has caused a serious water supply problem, especially during energy crisis periods; the water being an expensive commodity. Now, all conventional flush toilets are usually operated by pressing a lever, which pulls a chain or the like to open a water outlet permitting water to flow from a tank for flushing. Usually, the water level in the water tank is controlled with a ball buoy. Whenever pressing the lever once, a volume of several liters of water will be flushed away; such case would be considered a waste during only releasing a urine. By the rate of flushing decades of liters of water each day, the volume of water to be flushed by the people of the whole world would be a surprising figure.

In case of a drought season appearing, water crisis will be resulted. Further, in the conventional flush toilet, the chain in the water tank is liable to be broken because of daily pulling tension to cause the lid unable to tightly close the water stop outlet; consequently, a water leak, which is another way of wasting the water, often results in addition to often required repair work. It is apparent that the conventional flush toilet is not practical in use because of wasting water. Moreover, the water stop lid in the conventional flush toilet is made of rubber in conic shape and hollow in its core; it is usually pulled with a cord to flush the water, and also is liable to cause a leak from the rift as a result of a loosing cord; therefore, it may be deemed as a bad product.

SUMMARY OF THE INVENTION

In view of the drawbacks of the conventional flush toilet equipment, the present invention is directed to a new water control device for flush toilet, of which the main feature is that the operation is done by means of a cam on the main axle coupling to an actuating rod, and the hydraulic control device so as to have the actuating axle controlling the actuating rod of a level to control the flushing of water in different phases in an appropriate volume.

Another feature of this invention is that in the hydraulic cylinder, a spring and a piston are furnished, and on the piston, a connecting rod is fixedly attached, and is coupled to a main axle so as to push the piston and the spring down to a given point; then, the spring will stretch upwards to push the piston so as to actuate the lever to push the actuating rod downwards to tightly close the water outlet without leaking.

A further feature of this invention is that the actuating rod comprises two sections which are connected together with a connecting sleeve. The upper end of the actuating rod is hooked into a hole at the front end of the lever, and the lower end of it is hooked to the water stop lid. The actuating rod is actuated with the actuating axle thru the lever to directly open/close the water stop lid quickly and stably without breaking, and loosing.

A still further feature of this invention is that the round pad having scales on the axle seat can show a user by rotating the handle to a scale desired so as to control the water volume to be flushed by a pre-determined time thru said round sliding cam of the main axle, and the piston in the hydraulic cylinder.

DETAILED DESCRIPTION OF THE PREFERRED EMBODIMENT

Figure 1:
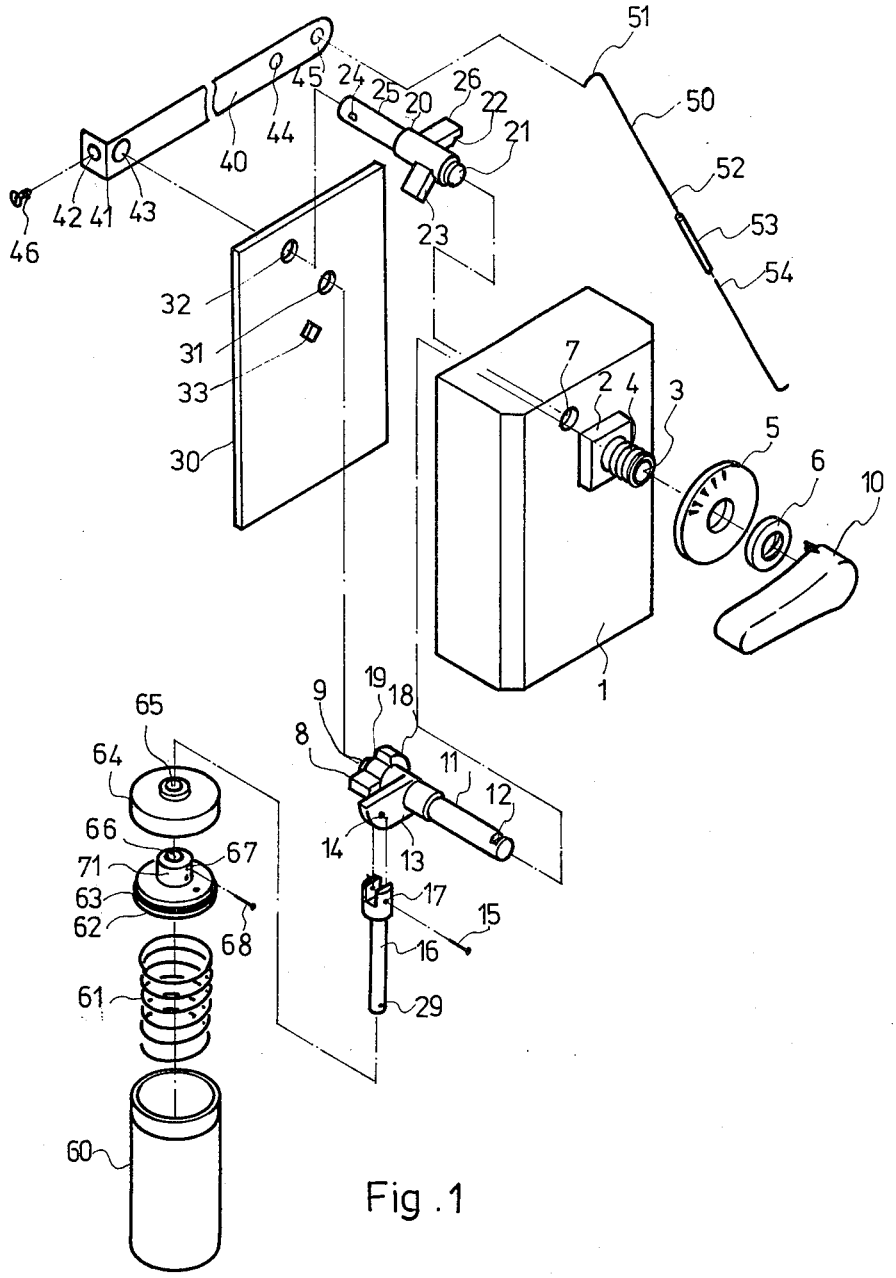
FIG. 1 shows an exploded view of the structure of this invention.

As shown in FIG. 1, there is provided a box (1) which is a hollow rectangular body, of which the outer surface is mounted with a square base (2); in the central hole of said base, an axle seat (3) with threads (4) is fitted, extending outwards. A round pad (5) with a calibration scale on the surface thereof is sleeved over said axle seat (3) and is fixedly attached to said seat with a nut. The handle (10) is fitted on the notch stud (12) at the front end of said main axle (11). At the upper left of said square base (2), a thru hole (7) is furnished on said box (1) for mounting a round salient block (21) at the front end of an actuating axle (20).

The front end of main axle (11) forms notch stud (12) being fitted into axle seat (3), and salient piece (13) at the rear portion of main axle (11) having a small hole (14) is coupled to a connecting rod (16) with a pin (15) thru small hole (14) and round hole (17) on rod (16). At the rear portion of main axle (11), a round sliding cam (18) having a catch flange (19) at one side, and having a catch piece (8) at the opposite side of catch flange (19); at the rear tip of axle (11), a round salient piece (9) is fitted into a round hole (31) on box bottom (30).

The front tip of actuating axle (20) forms round salient piece (21) for fitting into the thru hole (7). At the right side of axle (20), a supporting piece (26) having a ctach slot (22) under its front tip is furnished, and at the left side of axle (20), a catch piece (23) is furnished; the rear end having a round hole (24) of axle (20) forms into a round rod (25), which is fitted into the round hole (32) on the box bottom (30).

The lever (40) is a long strip with the front end being formed into a bent piece (41) having a round hole (42), and with a large round hole (43) at the front end and two round holes (44, 45) at the rear end. Said lever (40) is fixed to said round rod (25) by having rod (25) passing thru large round hole (43), and by using a screw (46) to fit thru round holes (42) and (24).

An actuating rod (50) includes two sections, of which the upper end of the front section forms into a catch hook (51) for hooking into the round holes (44,45) of lever (40), and the lower end of front section of said rod (50) is furnished with threads so as to connect, by screwing leftwards, to the top of a connecting sleeve (53). The rear section of rod (50) has threads (54) on the top thereof for connecting, by screwing rightwards, to the bottom of sleeve (53), and the other end of the section is hooked to the water stop lid (81) (see FIG. 4). The whole length of rod (50) may be adjusted by adjusting the length of the two sections screwed into the connecting sleeve (53).

Box bottom (30) is a rectangular thin plate, on which two round holes (31,32) and a small salient block (33) are furnished. The hydraulic control assembly of this invention comprises a hollow hydraulic cylinder (60), in which a spring (61) and a piston (62) with oil seal (63) are furnished.

On the top of cylinder (60), a rubber lid (64) is provided. The connecting rod (16) goes thru the round hole (65) of said rubber lid (64) and the round hole (66) of the piston (62) so as to have the small hole (29) on the connecting rod (16) coincided with the small hole (67) of said piston (62), and being penetrated with the pin (68) for fixing the connecting rod (16) and the piston (62) together.

Figure 2:
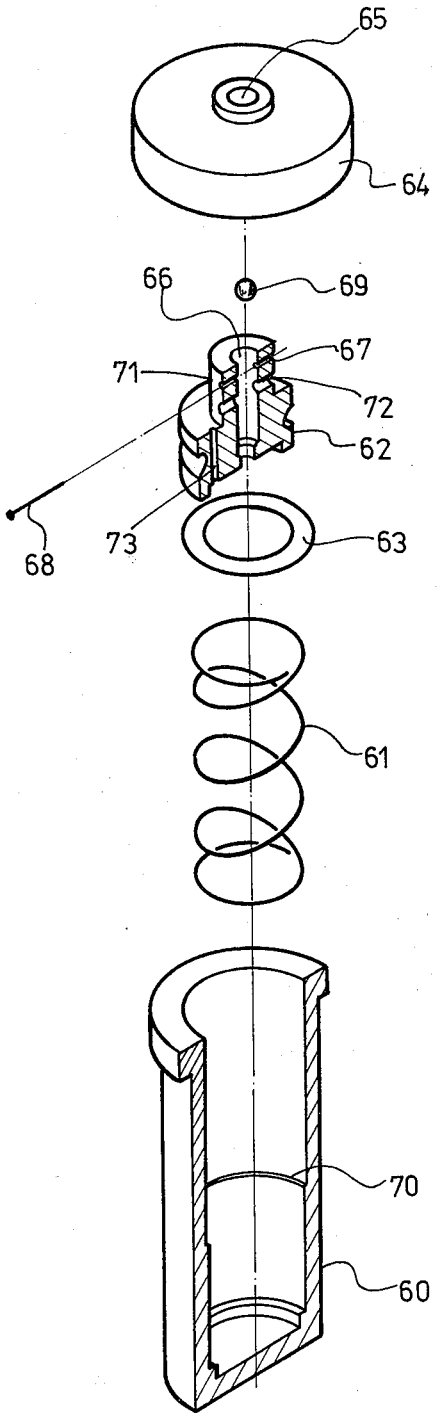
FIG. 2 shows an exploded view of the hydraulic device in this invention.

FIG. 2 shows the exploded view of structure of the hydraulic control assembly. Inside the hydraulic cylinder (60), a ring flange (70) is furnished, and from ring flange (70) to the top portion of said cylinder (60), a little play is maintained between piston (62) and the inner wall of cylinder (60), while in the portion of cylinder (60) from ring flange (70) to the bottom of the cylinder, there is no play. A round salient piece (71) on the top of said piston (62) has an oil outlet (72); an oil inlet (73) is furnished vertically on the flat surface of said piston (62), and in the central round hole (65), a steel ball (69) is ftted as a check valve.

Figure 3:
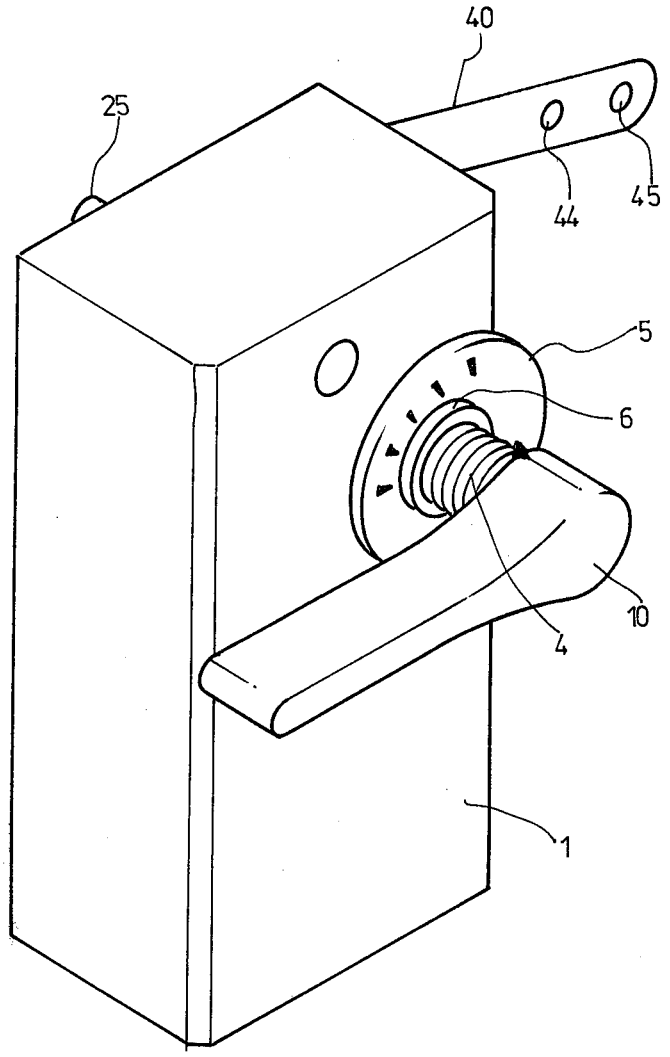
FIG. 3 shows an outer view of this invention.

FIG. 3 shows the outer view of this invention. When it is completely assembled with all the components as shown in FIGS. 1 and 2, it will be tightly sealed. For use, it is necessary to press the handle (10) to rotate main axle (11); at the same time, the catch flange (19) of cam (18) disengages from the catch slot (22) of the actuating axle (20), and cam (18) surface will slowly rotate counter-clockwise; then, connecting rod (16) attached to the salient piece (13) of the main axle (11) will push the piston (62) in hydraulic cylinder (60) downwards to press the spring (61). Now, the hydraulic fluid in the hydraulic cylinder (60) will push steel ball (69) moving upwards and will flow out of oil outlet (72) and enter into the top portion of hydraulic cylinder (60). Upon said spring (61) stretching upwards, the piston (62) will move upwards, and the hydraulic fluid will, thru the oil inlet (73), flow into the empty portion under piston (62). Simultaneously, the connecting rod (16) will drive the main axle (11) and actuate cam (18) to rotate clockwise till the top of connecting rod (16) touches the catch piece (23) of the actuating axle (20), and till the catch flange (19) engages with the catch slot (22) of the supporting piece (26). As soon as the piston (62) inside the hydraulic cylinder (60) moves from the portion below the ring flange (70) over the ring flange, it will raise rapidly as a result of having play with the inner wall surface of cylinder (60). Such rapidly raising force will cause the lever (40) turning downwards to actuate the actuating rod (50) pushing downwards so as to close the water stop lid (81).

Figure 4:
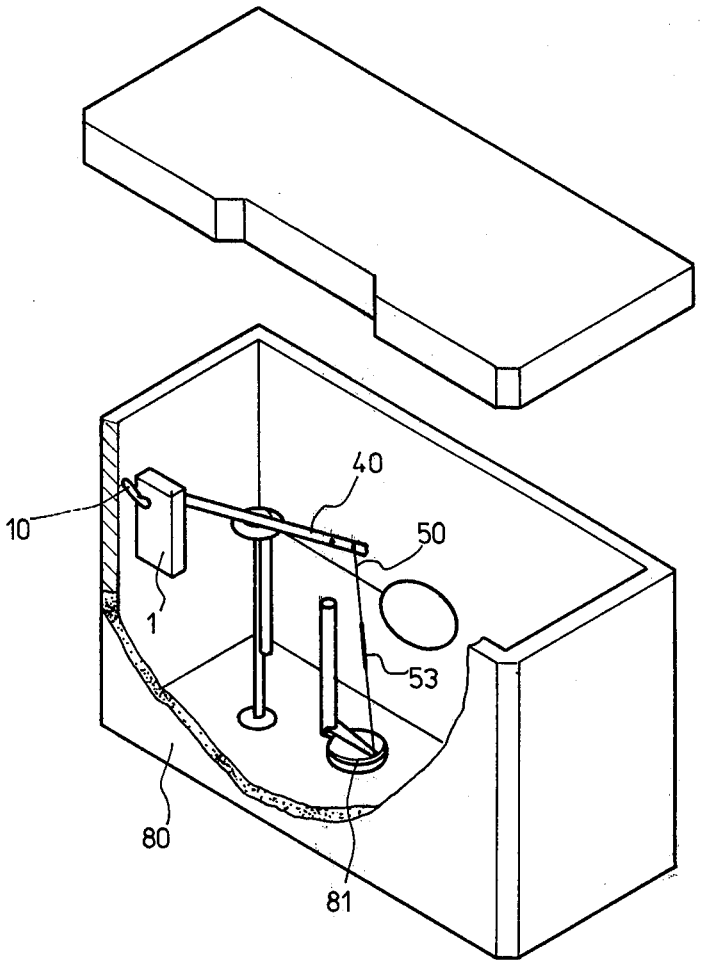
FIG. 4 shows the invention installed in a toilet in the presently preferred manner.

FIG. 4 shows the embodiment of this invention being installed in the water tank (80) of a flush toilet. As shown in the preceding Fig., box (1) is installed inside the water tank (80) with the handle (10) being left outside the tank (80). The actuating rod (50) is connected the water stop lid (81), which is a solid piece of rubber.

Since this invention is designed to flush the water in four different phases, as shown by the calibration scale on round pad (5), within ten seconds, each phase will last for 2.5 seconds, and the hydraulic fluid that is pumped above said piston (62) will just flow back within ten seconds. The calibration marks shown on said round pad (5) are 2.5 seconds in the first phase, five seconds in the second phase, 7.5 seconds in the third phase, and ten seconds in the 4th phase. When the user turn handle (10) to the first scale (2.5 seconds), the supporting piece (26) of said actuating axle (20) will rotate as a result of being driven by cam (18) to move the lever (40) upwards and to pull the actuating rod (50) to open water stop lid (81) for flushing; simultaneously, the fluid flowed out of the oil outlet (72) will, thru the oil inlet (73), flow back, and the piston (62) caused by the rebounding force of the spring (61) will pull the connecting rod (16) backwards to rotate the main axle (11), which will actuate said actuating axle (20) rotating reversely to cause the lever (40) moving downwards so as to have the actuating rod (50) pressing the water stop lid (81) for closing the water outlet. By the same theory, said device will operate in the rest phases; upon the time of each phase being up, the water will automatically be closed. For example, during urine discharging, the user may just rotate the handle to the first or second phase scale; during moving the bowel, the user may rotate the handle to the third or 4th phase scale. Such phase flushing method will fulfil the purpose of saving water.

I claim:

1. A water control device for a flush toilet comprising:

a hollow box having a square base and a central thru hole therein for receiving an axle seat having threads;

a round calibration pad attached to said axle seat and fixed thereto with a nut, and a handle for being fitted over a main axle extending out thru said axle seat, and a thru hole located at the upper left of said square base;

a main axle having a notch stud at a front end thereof, received in said box and extending out thru said central hole, and having a small coupling hole and having a round sliding cam at a right side thereof and also having a catch flange and a catch piece at the left side thereof and a round salient piece at a rear tip thereof;

a box bottom of rectangular thin piece having two round holes therein and a small salient block, and able to be tightly connected with said box, the round salient piece at the rear tip of the catch piece fitting into one of said holes;

a handle attached to said main axle for rotating said main axle by a user;

a connecting rod, coupled to said main axle with a pin passed through said connecting rod and said coupling hole in said main axle, arranged to move in response to rotation of said main axle;

an actuating axle having a round salient piece at a front end able to fit into the thru hole of said box, and a supporting piece, at the right side of a front end thereof, and having a catch slot at said front end, and a catch piece at the left side of its front end, and a round rod with a hole at a rear tip thereof;

a lever in the form of a long strip having a round hold in a bent portion thereof for receiving a screw therethrough for attaching said lever to said round rod of said actuating axle, and a large round hole at a front end of said lever, and having two holes at a rear end thereof;

an actuating rod assembly including front and rear sections and a connecting sleeve, the top of the front section being formed as a catch hook for hooking into one of said holes at the rear end of said lever, a lower end of said front section having threads for screw attachment into said connecting sleeve, the front and rear sections having threads for screwing into said connecting sleeve, a lower end of said rear section being formed into a hook;

a hydraulic control assembly including a hollow hydraulic cylinder having a ring flange on an inner wall surface thereof, a spring, a round salient piston having an oil seal and having a central hole thru said round salient piece and a steel ball fitted in said round hole, and on a side of said piston, hole and an oil outlet, and a vertical oil inlet, and a rubber lid at a top of said hydraulic cylinder said spring for biasing said piston, said hydraulic assembly being actuated to move said piston against the bias of said spring by said connecting rod, attached thereto through said central hole, for controlling the time of a flush as a function of the degree of rotation of said main axle, the returning of the piston to its biased position causing the flush to end.

2. A water control device for a flush toilet as claimed in claim 1, wherein the catch flange of said main axle engages with the catch slot of said actuating axle, and wherein when said main axle, driven by said handle, rotates counter clockwise, the cam of said main axle causes the supporting piece of said actuating axle to move upwards to move the lever for pulling the actuating rod upwards to open a water stop lid of said toilet for flushing.

3. A water control device for a flush toilet as claimed in claim 1, wherein said connecting rod is pin coupled to said piston so that said connecting rod can force the operation of said piston.

4. A water control device for a flush toilet as claimed in claim 1, wherein said hydraulic control assembly is arranged such that there is a degree of play between said piston and the hydraulic cylinder inner wall surface in the portion above said ring flange, and there is substantially no play between said two parts in the portion below said ring flange so as to obtain two different speeds during said piston moving back and forth.

5. A water control device for a flush toilet as claimed in claim 1, wherein said round calibration pad is furnisehd with scales to indicate that the water may be flushed in a given volume in different phases within a predetermined time.

6. A water control device for a flush toilet as claimed in claim 1, further comprising a small salient block associated with said box for stopping the rotation of said main axle whenever the catch piece of said main axle touches said block.

7. A water control device for a flush toilet as claimed in claim 1, wherein after actuating said hydraulic control assembly, the force of the spring pushes the piston upwards to cause the connecting rod to rotate the main axle clockwise, and also to cause, thru the cam, the actuating axle to rotate so as to have the lever pushing the actuating rod downwards to press the water stop lid for stopping the flushing.

* * * * *